US010072826B2

(12) United States Patent
Gielen et al.

(10) Patent No.: US 10,072,826 B2
(45) Date of Patent: Sep. 11, 2018

(54) LIGHT BULB WITH SOLID-STATE LIGHTING DEVICES

(71) Applicant: PHILIPS LIGHTING HOLDING B.V., Eindhoven (NL)

(72) Inventors: Vincent Stefan David Gielen, Eindhoven (NL); Antonius Adrianus Maria Marinus, Eindhoven (NL); Martijn Jochem Van Uden, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/580,282

(22) PCT Filed: Jun. 8, 2016

(86) PCT No.: PCT/EP2016/063025
§ 371 (c)(1),
(2) Date: Dec. 7, 2017

(87) PCT Pub. No.: WO2016/198448
PCT Pub. Date: Dec. 15, 2016

(65) Prior Publication Data

US 2018/0163952 A1 Jun. 14, 2018

(30) Foreign Application Priority Data

Jun. 11, 2015 (EP) ..... 15171562

(51) Int. Cl.
*F21V 17/00* (2006.01)
*F21K 9/232* (2016.01)
(Continued)

(52) U.S. Cl.
CPC ..... *F21V 19/003* (2013.01); *F21K 9/232* (2016.08); *F21V 19/0075* (2013.01); *F21Y 2107/30* (2016.08); *F21Y 2115/10* (2016.08)

(58) Field of Classification Search
CPC .... F21V 19/003; F21V 19/0075; F21V 17/04; F21V 17/10; F21V 17/104; F21K 9/232
See application file for complete search history.

(56) References Cited

U.S. PATENT DOCUMENTS 8,752,983 B2 6/2014 Hussell et al.
8,757,839 B2 6/2014 Hussell et al.
(Continued)

FOREIGN PATENT DOCUMENTS

CN 201547538 U 8/2010
CN 202091839 U 12/2011
(Continued)

*Primary Examiner* — Thomas M Sember
(74) *Attorney, Agent, or Firm* — Akarsh P. Belagodu

(57) ABSTRACT

There is provided a light bulb (1) which comprises: a cap (2) for mechanically and electrically connecting the light bulb (1) to a lamp socket; a light-transmissive envelope (3); a stem (12) arranged inside the envelope (3), the stem (12) including a base portion (13) proximal to the cap (2); and at least one carrier (7) and one or more solid-state lighting devices (6) mounted on the at least one carrier (7) inside the envelope (3). The at least one carrier (7) is supported by the base portion (13) of the stem (12). There is also provided a method for producing a light bulb (1).

8 Claims, 5 Drawing Sheets

(51) Int. Cl.

| | |
|---|---|
| ***F21V 19/00*** | (2006.01) |
| *F21Y 115/10* | (2016.01) |
| *F21Y 107/30* | (2016.01) |

(56) References Cited

U.S. PATENT DOCUMENTS

| | | | | |
|---|---|---|---|---|
| 8,847,472 | B1 | 9/2014 | Titzler et al. | |
| 9,851,055 | B2 * | 12/2017 | Gielen | F21K 9/232 |
| 2013/0141892 | A1 | 6/2013 | Okazaki et al. | |
| 2014/0268826 | A1 | 9/2014 | Pickard et al. | |
| 2014/0340913 | A1 * | 11/2014 | Cui | F21V 29/006 362/382 |

FOREIGN PATENT DOCUMENTS

| | | | |
|---|---|---|---|
| CN | 202371505 | U | 8/2012 |
| CN | 103953861 | A | 7/2014 |
| EP | 2416056 | A2 | 2/2012 |
| EP | 2472169 | A2 | 7/2012 |
| EP | 2636940 | A1 | 9/2013 |
| JP | 2011249235 | A | 12/2011 |
| WO | WO2013084389 | A1 | 6/2013 |
| WO | WO2015185360 | A1 | 12/2015 |
| WO | WO2015197805 | A1 | 12/2015 |

* cited by examiner

LIGHT BULB WITH SOLID-STATE LIGHTING DEVICES

CROSS-REFERENCE TO PRIOR APPLICATIONS

This application is the U.S. National Phase application under 35 U.S.C. § 371 of International Application No. PCT/EP2016/063025, filed on Jun. 8, 2016, which claims the benefit of European Patent Application No. 15171562.0, filed on Jun. 11, 2015. These applications are hereby incorporated by reference herein.

TECHNICAL FIELD

The present invention relates to a light bulb based on solid-state lighting (SSL) technology.

BACKGROUND

There is currently a strong trend to replace general lighting service (GLS) bulbs, i.e. conventional incandescent light bulbs, with more modern alternatives such as light bulbs based on SSL technology since these typically have superior performance with respect to energy efficiency, operational lifetime and many other factors. An example of such a light bulb is disclosed in U.S. Pat. No. 8,757,839 B2. This document discloses a lamp having a light-emitting diode (LED) assembly supported by a tube that extends beyond the end of a stem (see FIG. 10 in U.S. Pat. No. 8,757,839 B2).

In the production of modern light bulbs, it is often desirable to, as much as possible, make use of conventional GLS production lines since these have been repeatedly improved with respect to speed and cost efficiency over several decades. Developing modern light bulbs that are largely compatible with existing GLS production lines is therefore an important area of industrial research.

SUMMARY

It would be advantageous to provide an improved or alternative light bulb based on SSL technology. An aspect of particular interest is the extent to which conventional GLS production lines can be used in the production of the light bulb.

To better address this concern, in a first aspect there is presented a light bulb comprising: a cap for mechanically and electrically connecting the light bulb to a lamp socket; a light-transmissive envelope; a stem arranged inside the envelope, the stem including a base portion proximal to the cap; and at least one carrier and one or more SSL devices mounted on the at least one carrier inside the envelope. The at least one carrier is supported by the base portion of the stem.

In order to be able to make use of existing GLS production lines in the production of a light bulb based on SSL technology, many of its parts should be similar to those of a GLS bulb. This is because GLS productions lines have limited flexibility as a result of their high degree of optimization. The light bulb described above can to a large extent be produced using much of the available GLS production lines with no, or only minor, modifications. In particular, the stem of the light bulb can be identical, or at least very similar, to the stem of a GLS bulb.

Moreover, the way in which the carrier is attached to the stem results in a robust construction capable of withstanding rough handling by the end user as well as strong forces (such as high g-forces) to which the lamp may be exposed during production.

According to one embodiment, the stem further includes a tube portion distal to the cap, the tube portion having a smaller diameter than the base portion. Such a stem can be very similar to the stem of a GLS light bulb. A stem of a light bulb often has a tube portion which supports the filament and through which a gas can be pumped into the envelope.

According to one embodiment, the base portion includes a distal cylindrical section and a proximal flared section. This is a common stem design for GLS bulbs. The stem is typically sealed to the envelope by the flared section.

According to one embodiment, the at least one carrier is directly supported by the base portion. In this embodiment, it is not necessary to attach the carrier to the base portion by means of or via a fastening device, something which may simplify the production of the light bulb.

According to one embodiment, the at least one carrier at least partly surrounds or clasps the distal cylindrical section, and a proximal edge of the at least one carrier rests on the proximal flared section.

According to one embodiment, the light bulb further comprises a fastening device. The at least one carrier is indirectly supported by the base portion via the fastening device which is attached to the base portion. Such light bulbs may be particularly robust and capable of withstanding rough handling. Further, the fastening means may electrically connect the carrier to contact wires emanating from the stem. Another way of electrically connecting the carrier is to connect the contact wires to carrier wires attached to the carrier. However, electrically connecting the carrier via the fastening device may be simpler since attaching the carrier wires to the carrier can be relatively difficult.

According to one embodiment, the light bulb further comprises contact wires emanating from the stem, and the at least one carrier is connected to the contact wires. The contact wires connect the carrier to the cap electrically and may also help fix the carrier mechanically to the stem by preventing the carrier from rotating around the stem and from slipping off the carrier.

According to one embodiment, the at least one carrier has a shape that at least partly surrounds the stem, and the at least one carrier is connected to the contact wires on the outside of the at least one carrier.

According to one embodiment, the at least one carrier has a shape that at least partly surrounds the stem, and the at least one carrier is connected to the contact wires on the inside of the at least one carrier. It may be advantageous to connect the carrier to the contact wires on the inside, especially in those embodiments where the contact wires are connected to carrier wires attached to the carrier since it is then relatively easy to align the contact and carrier wires with each other. Well-aligned wires make the connection between the carrier and the stem capable of withstanding large tensile forces in a direction away from the cap.

According to one embodiment, the carrier comprises carrier wires connected to the contact wires. Each pair of connected carrier and contact wires form an angle of less than 45 degrees where the wires are connected together, alternatively less than 30 degrees, less than 20 degrees or less than 10 degrees. Aligning the carrier and contact wires as much as possible with each other where they are connected aligns their respective working lines. This creates a strong connection between the wires that can withstand large tensile forces in a direction away from the cap.

According to one embodiment, the carrier has a portion proximal to the cap, which portion comprises a plurality of holes. The holes help prevent the transfer of heat to the SSL devices, via the stem and the carrier, during sealing of the envelope. They also help prevent stresses in the stem resulting from large temperature differences that may occur during sealing of the envelope.

According to one embodiment, the at least one carrier is tubular-shaped. According to one embodiment, the at least one carrier has a tubular portion proximal to the cap and strips extending from the tubular portion in a direction away from the cap. The SSL devices may be mounted on the strips. The carrier described above has an open structure through which the gas inside the light bulb can flow easily, something which may give rise to a thermal chimney effect. This improves the transfer of heat generated by the SSL devices to the outside of the light bulb. Moreover, the strips are easy to shape by bending, twisting and/or folding, resulting in a great deal of freedom in the positioning of the SSL devices and in choosing the directions in which they emit light. The carrier therefore facilitates the provision of the best light distribution for the intended application. Moreover, since a carrier with this design can have an open structure through which the gas inside the envelope can flow easily, heat can be efficiently transferred away from the SSL devices to the surrounding gas inside the envelope.

According to one embodiment, the light bulb is a gas-filled light bulb. The gas, for example helium, may improve thermal performance by giving better heat transfer from the SSL devices to the envelope. The light bulb may contain a mix of gases, for example a mix of helium and oxygen. Using a mix of gases may improve the lifetime of the light bulb by reducing lumen depreciation of the SSL devices.

According to a second aspect, there is presented a method for producing a light bulb. The method comprises: providing a stem having a base portion; mounting at least one carrier to the stem so that the carrier is supported by the base portion, the carrier having one or more SSL devices; arranging a cap proximal to the base portion, the cap being adapted to mechanically and electrically connect the light bulb to a lamp socket; and arranging the stem and the carrier inside a light-transmissive envelope. The second aspect may have the same or similar features and technical effects as the first aspect.

It is noted that the invention relates to all possible combinations of features recited in the claims.

BRIEF DESCRIPTION OF THE DRAWINGS

This and other aspects of the present invention will now be described in more detail with reference to the appended drawings on which.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
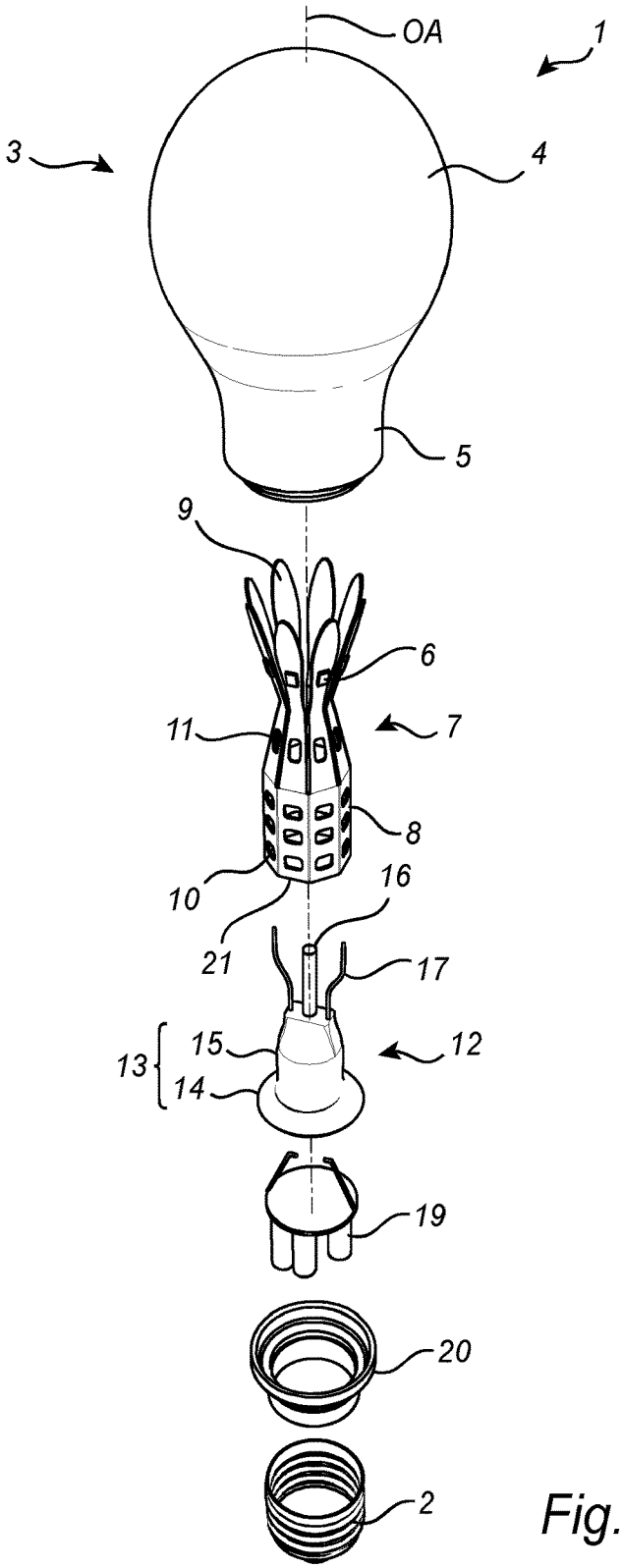
FIG. 1 is a schematic exploded view of an example of a light bulb.

FIG. 1 shows a light bulb 1 having an optical axis OA. The optical axis OA is a central axis of the light bulb 1, and the lighting generated by the light bulb 1 is in this example substantially rotationally symmetric around the optical axis OA. The light bulb 1 has a cap 2 arranged at an end of the light bulb 1, the cap 2 being adapted to mechanically and electrically connect the light bulb 1 to a lamp socket. The cap 2 is typically made of a metal. In the illustrated example, the cap 2 is a screw base, but the cap 2 may be of a different type, for example a bayonet light bulb mount.

The light bulb 1 also has a light-transmissive envelope 3, the center of which is displaced along the optical axis OA relative to the cap 2. The envelope 3 can be made of glass or plastics, for instance. In the illustrated example, the envelope 3 has a pear-like shape formed by a round head portion 4 and a circular cylindrical neck portion 5, the head portion 4 and neck portion 5 being distal and proximate to the cap 2, respectively. The envelope 3 is filled with a gas so the light bulb 1 is a gas-filled light bulb. The gas may for example be a mix of helium and oxygen. The gas may comprise between 5% and 10% oxygen.

Several SSL devices 6 are arranged inside the envelope 3. In other embodiments, there may be a single SSL device 6. The SSL devices 6 can for example be semiconductor LEDs, organic LEDs, polymer LEDs, or laser diodes. All of the SSL devices 6 may be configured to emit light of the same color, for example white light. Alternatively, different SSL devices 6 may be configured to emit light of different colors.

The SSL devices 6 are mounted on a carrier 7 which electrically connects the SSL devices 6 to a driver 19 for driving the SSL devices 6. The driver 19 is electrically connected to the cap 2. An isolation part 20, which electrically isolates some parts of the driver 19 from the cap 2, may be arranged between the driver 19 and the cap 2. The carrier 7 also functions as a heat sink enabling efficient heat transfer from the SSL devices 6 to the surrounding gas inside the envelope 3. The SSL devices 6 and the carrier 7 together form a three-dimensional L2 structure. The carrier 7 may comprise a printed circuit board, such as a flexible printed circuit board, a bendable metal core printed circuit board or similar. The carrier 7 may comprise a sheet metal, for example aluminum, that has been formed into a desired three-dimensional shape, typically by cutting, bending and/or folding. In this embodiment, the carrier 7 has a tubular portion 8 proximal to the cap 2 and several strips 9 extending from the tubular portion 8 in a direction generally along the optical axis OA away from the cap 2. The tubular portion 8 is centered on the optical axis OA. The cross-section of the tubular portion 8 perpendicular to the optical axis OA is typically circular or polygonal, such as rectangular, hexagonal or octagonal. The strips 9 are arranged substantially circularly around the optical axis OA.

The strips 9 are flat and elongated, resembling fingers. The strips 9 have slightly different lengths but may have the same length in other examples. Each strip 9 has a V-like shape that tapers slightly towards the middle of the strip 9. The leg of the V that is distal to the tubular portion 8 has a drop-like shape and supports one SSL device 2 on the side that faces the envelope 3. Each SSL device 6 has a main direction of illumination that is directed slightly downwards in FIG. 1, i.e. slightly towards the cap 2. In other examples, there may be two or more SSL devices 2 mounted on each strip 9.

The tubular portion 8 has a plurality of holes 10 which help reduce the risk of heat damage to the SSL devices 6 during production, especially when the envelope 3 is sealed. The strips 9 may be provided with openings 11 through which, for example, electrical wires for the SSL devices 6 may pass from one side of the carrier 7 to the other. In other embodiments of the light bulb 1, the carrier 7 may or may not have the holes 10 and/or the openings 11.

A stem 12, which can be made of for example glass or plastics, is arranged inside the envelope 3. The carrier 7 is supported by the stem 12, or, more precisely, by a base portion 13 of the stem 12. The base portion 13 is located proximal to the cap 2, approximately in level with the neck portion 5 of the envelope 3. The base portion 13 includes a flared section 14 and a cylindrical section 15 which are proximal and distal to the cap 2, respectively. The flared section 14 is sometimes referred to as a "flare", and the cylindrical section 15 is sometimes referred to as a "flare tube". The cylindrical section 15 is circular cylindrical but may in other examples be polygonal cylindrical, such as hexagonal cylindrical or octagonal cylindrical. The flared section 14 is tapered, becoming wider towards the cap 2. In other examples, the flared section 14 may be substantially flat. The carrier 7 completely surrounds the base portion 13 as seen along the optical axis OA. In other embodiments, the base portion 13 may be only partly surrounded by the carrier 7. The carrier 7 may then have a C-like cross section as seen along the optical axis OA. An edge 21 of the carrier 7, proximal to the cap 2, rests on the flared section 14 so that the carrier 7 is directly supported by the base portion 13. The flared section 14 thereby prevents the carrier from moving along the optical axis OA towards the cap 2. The flared section 14 is usually sealed to the envelope 3, for example by being fused to the envelope 3.

The stem 12 also has a tube portion 16, sometimes referred to as an "exhaust tube", through which a gas may be introduced into the envelope 3. The tube portion 16 has a smaller diameter than the base portion 13 and extends in a direction away from the cap 2 into the envelope 3. The tube portion 16 is distal to the cap 2, whereas the base portion 13 is proximal to the cap 2. It should be noted that the stem 12 may or may not have a tube portion 16 in other embodiments (see FIG. 3).

The stem 12 comprises contact wires 17, sometimes referred to as "lead in wires", which emanate from the stem 12 and are connected to the carrier 7, for example by soldering or welding or by means of a clamp. The contact wires 17 help fix the carrier 7 mechanically to the stem 12 by preventing the carrier 7 from rotating around the stem 12 and slipping off the stem 12 in the direction away from the cap 2 towards the envelope 3. The contact wires 17 also connect the carrier 7 electrically to the cap 2 to the driver 19.

It should be noted that, in other embodiments, the carrier 7 may be fixed to the stem 12 in some other way than the one described above. The carrier 7 may for example clasp or clamp the cylindrical section 15, or there may be a separate fastening device (see FIGS. 7-9). In such embodiments, it is thus not the contact wires 17 in combination with the flared section 14 that ultimately fix the carrier 7 to the stem 12.

Figure 2:
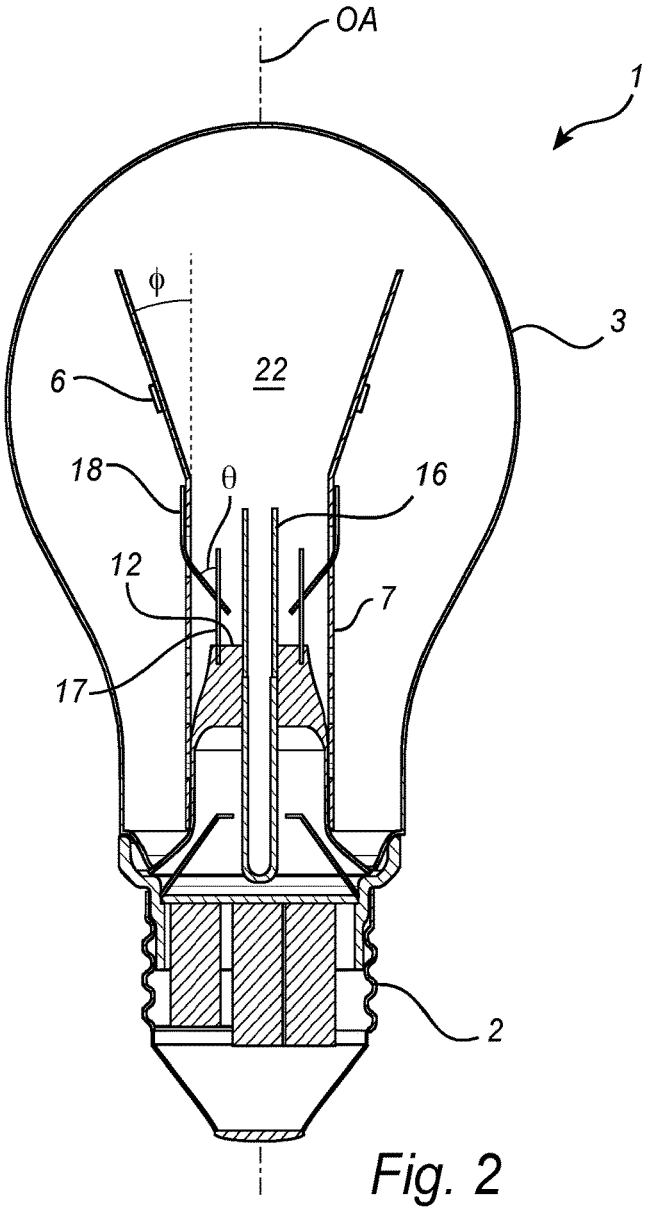
FIG. 2 is a schematic cross-sectional side view of another example of a light bulb.

FIG. 2 shows a light bulb 1 which is similar to the one in FIG. 1 except that the carrier 7 is different. Each of the strips 9 of the carrier in FIG. 2 has a first portion, which is proximal to the stem 12 and substantially parallel with the optical axis OA, and a second portion which is distal to the stem 12 and which is inclined by an angle $\phi$ with respect to the optical axis OA. The angle $\phi$ can for example be about 30 degrees. As a result, each SSL device 6 has a main direction of illumination that is directed slightly downwards in FIG. 2, i.e. slightly towards the cap 2. As is illustrated in FIG. 2, the carrier 7 comprises carrier wires 18 to which the contact wires 17 are connected, for example by means of a clamp or by being welded or soldered together. The contact and carrier wires 17, 18 are connected on the inside 22 of the carrier 7. In each pair of connected contact and carrier wires 17, 18, the wires are aligned so as to form an angle $\theta$ of less than 45 degrees relative to each other where the wires are connected to each other.

Figure 3:
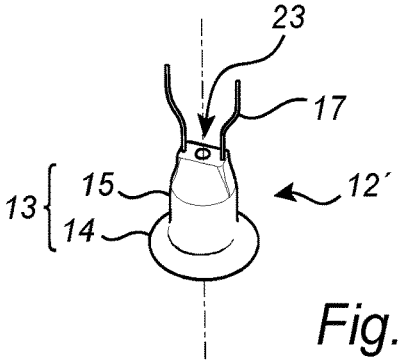
FIG. 3 is a schematic perspective view of an example of a stem.

FIG. 3 shows a stem 12' that lacks the tube portion 16 of the stem 12 in FIGS. 1 and 2. Instead, this stem 12' has a surface opening 23 (which is functionally equivalent to the tube portion and for that reason will be referred to as tube portion as well) through which a gas can be introduced into the envelope 3. The flared section 14 supports the tubular portion 8 as an abutment.

Figure 4:
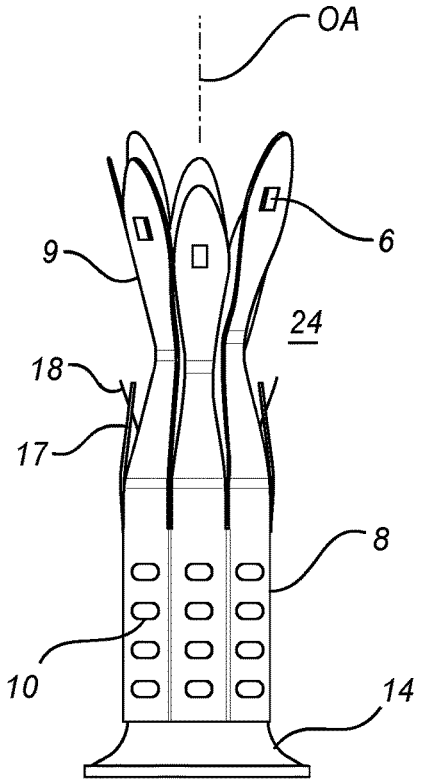
FIGS. 4 and 5 are schematic side views of examples of carriers having strips.

FIG. 4 shows a carrier 7 on a stem 12. The shape of the carrier 7 is similar to that of the carrier 7 in FIG. 1. The contact wires 17 and the carrier wires 18 are connected on the outside 24 of the carrier 7.

Figure 5:
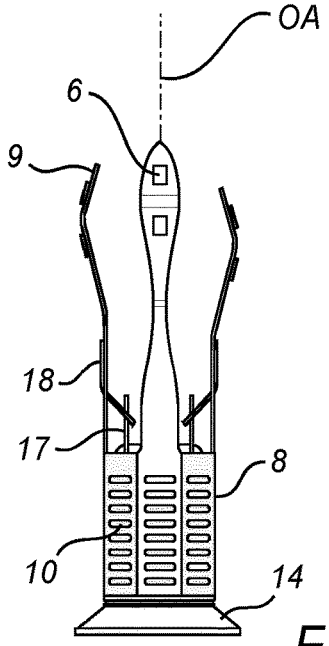

FIG. 5 shows a carrier 7 on a stem 12 which are similar to the one in FIG. 1 except that the carrier 7 is different. In FIG. 5, the portion of each strip 9 that is most distal to the tubular portion 8 has a substantially V-shaped cross section. One SSL device 6 is mounted on each V's "leg" so there are two SSL devices 6 on each strip 9. Each strip 9 thus has one SSL device 6 whose main illumination direction is pointing slightly downwards in FIG. 5, and one SSL device 6 whose main illumination direction is pointing slightly upwards. This results in a wide distribution of light. The strips 9 have different lengths, but this may not be the case in other examples.

Figure 6:
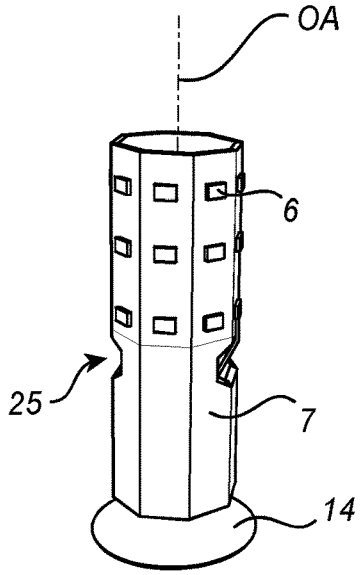
FIG. 6 is a schematic perspective view of an example of a tubular-shaped carrier.

FIG. 6 shows a carrier 7 on a stem 12 which are similar to the ones in FIG. 1 except in that the entire carrier 7 in FIG. 6 is tubular-shaped and lacks the strips 9. The cross section of the carrier 7 perpendicular to the optical axis OA may for example be circular or polygonal, such as rectangular, hexagonal or octagonal. The flared section 14 supports the carrier 7 as an abutment. The carrier 7 may have side openings 25 which facilitate access to the inside of the carrier 7 so that the contact wires 17 can be attached to the carrier 7 more easily.

Figure 7:
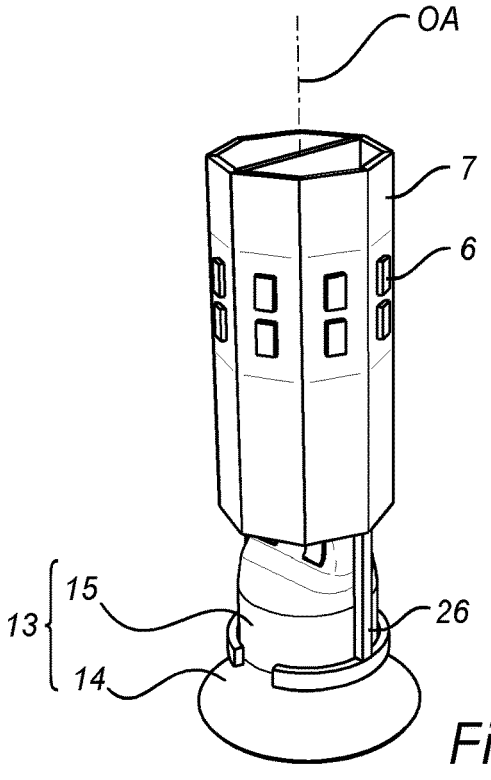
FIG. 7 is a schematic perspective view of an example of a carrier having a fastening device.
Figure 8:
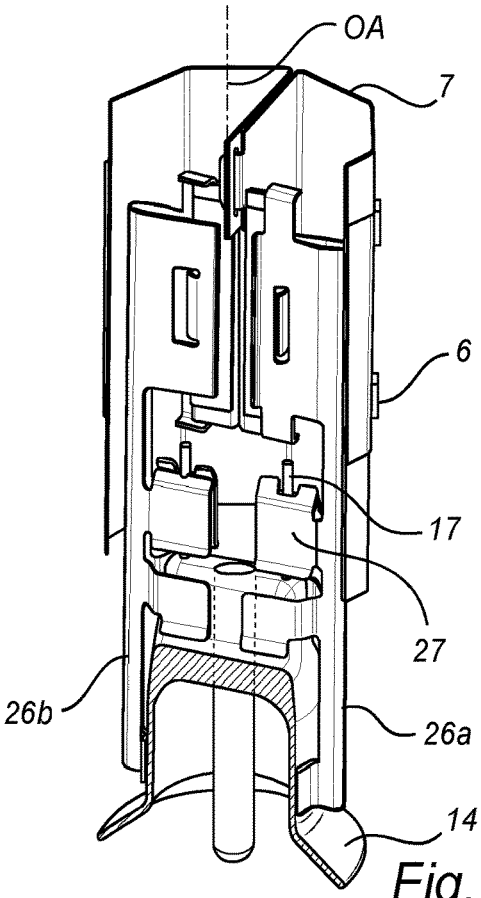
FIG. 8 is a cross-sectional perspective view of the carrier in FIG. 7.

FIGS. 7 and 8 show a carrier 7 which is indirectly supported by a stem 12 via a fastening device 26 comprising two parts 26*a*, 26*b*. The fastening device 26 is attached to the base portion 13 by clasping or clamping the cylindrical section 15, and extends upwards into the tubular-shaped carrier 7 which is mechanically and electrically connected to the fastening device 26 on the inside. The two parts 26*a*, 26*b* are arranged opposite to each other around the stem 12. Each part 26*a*, 26*b* has attachment means 27 for attaching the fastening device 26 to the contact wires 27. In this example, the attachment means 27 clamps the contact wires 17.

Figure 9:
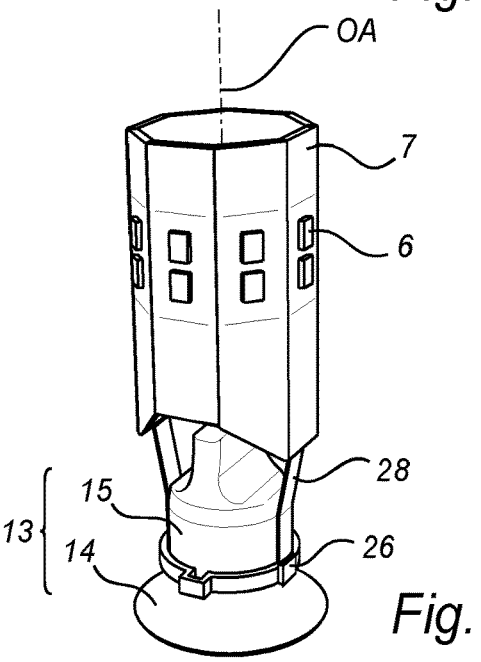
FIG. 9 is a schematic perspective view of another example of a carrier having a fastening device.

FIG. 9 shows a carrier 7 that is indirectly supported by a stem 12 via a fastening device 26. In this example, the fastening device 26 has a ring-like shape and is attached to the base portion 13 by clasping or clamping the cylindrical section 15. The carrier 7 has two tabs 28 arranged between the cylindrical section 15 and the fastening device 26. There may be a different number of tabs 28 than two in other examples.

The light bulb 1 is put in operation by plugging the cap 2 into an electrical socket connected to an electricity supply, whereby the driver 19 supplies power to the SSL devices 6 via the contact wires 17 and the carrier 7. The SSL devices 6 emit light that is transmitted through the envelope 3.

A method for producing the light bulb 1 may comprise: providing the stem 12 having the base portion 13; mounting the at least one carrier 7 to the stem 12 so that the carrier 7 is supported by the base portion 13, wherein the carrier 7 has one or more SSL devices 6; arranging the cap 2 proximal to the base portion 13, wherein the cap 2 is adapted to mechanically and electrically connect the light bulb 1 to a lamp socket; and arranging the stem 12 and the carrier 7 inside the light-transmissive envelope 3.

The person skilled in the art realizes that the present invention by no means is limited to the preferred embodiments described above. On the contrary, many modifications and variations are possible within the scope of the appended claims. For example, the shape of the envelope 3 is not limited to a pear-like shape. Some examples of other envelope shapes include cylindrical, ellipsoidal and conical.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A light bulb comprising:

a cap for mechanically and electrically connecting the light bulb to a lamp socket;

a light-transmissive envelope;

a stem arranged inside the envelope, the stem including a base portion proximal to said cap and a tube portion distal to the cap, having a smaller diameter than the base portion, said light bulb being filled with a gas through said tube portion; and at least one carrier and one or more solid-state lighting devices mounted on the at least one carrier inside the envelope, wherein the base portion includes a distal cylindrical section and a proximal flared section, and the at least one carrier at least partly surrounds or clasps said distal cylindrical section, and wherein a proximal edge of the at least one carrier rests on said proximal flared section and wherein the carrier has a portion proximal to the cap, which portion comprises a plurality of holes.

2. The light bulb according to claim 1, further comprising a fastening device, wherein the at least one carrier is indirectly supported by the base portion via said fastening device which is attached to the base portion.

3. The light bulb according to claim 1, further comprising contact wires emanating from the stem, wherein the at least one carrier is connected to the contact wires.

4. The light bulb according to claim 3, wherein the at least one carrier has a shape that at least partly surrounds the stem, and wherein the at least one carrier is connected to the contact wires on an outside of the at least one carrier.

5. The light bulb according to claim 3, wherein the at least one carrier has a shape that at least partly surrounds the stem, and wherein the at least one carrier is connected to the contact wires on an outside of the at least one carrier.

6. The light bulb according to claim 3, wherein the carrier comprises carrier wires connected to the contact wires, and wherein each pair of connected carrier and contact wires form an angle of less than 45 degrees where the wires are connected together.

7. The light bulb according to claim 1, wherein the at least one carrier is tubular-shaped.

8. The light bulb according to claim 1, wherein the at least one carrier has a tubular portion proximal to the cap and strips extending from the tubular portion in a direction away from the cap.

* * * * *